US008356557B2

(12) United States Patent
Schneider

(10) Patent No.: US 8,356,557 B2
(45) Date of Patent: Jan. 22, 2013

(54) VEHICLE HAVING ROLLING COMPENSATION

(75) Inventor: Richard Schneider, Löhningen (CH)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 13/259,565

(22) PCT Filed: Mar. 9, 2010

(86) PCT No.: PCT/EP2010/052978

§ 371 (c)(1),
(2), (4) Date: Dec. 21, 2011

(87) PCT Pub. No.: WO2010/112306

PCT Pub. Date: Oct. 7, 2010

(65) Prior Publication Data

US 2012/0137926 A1 Jun. 7, 2012

(30) Foreign Application Priority Data

Mar. 30, 2009 (DE) ..... 10 2009 014 866

(51) Int. Cl.
*B61F 3/00* (2006.01)

(52) U.S. Cl. ..... 105/199.2; 105/413

(58) Field of Classification Search ..... 105/199.2, 105/413, 198.1–198.7
See application file for complete search history.

(56) References Cited

U.S. PATENT DOCUMENTS 3,439,631 A * 4/1969 Cope ..... 105/198.3
3,459,139 A * 8/1969 Love ..... 105/199.2
3,818,841 A * 6/1974 Julien ..... 105/164
3,868,911 A * 3/1975 Schultz ..... 105/164
4,440,093 A * 4/1984 Kakehi et al. ..... 105/164
4,516,507 A * 5/1985 Dean, II ..... 105/199.2
5,222,440 A * 6/1993 Schneider ..... 105/199.1
5,454,329 A * 10/1995 Liprandi et al. ..... 105/199.2
5,558,024 A * 9/1996 Solera et al. ..... 105/199.2
5,560,589 A * 10/1996 Gran et al. ..... 267/3
5,564,342 A * 10/1996 Casetta et al. ..... 105/199.2
5,921,185 A * 7/1999 Hoyon et al. ..... 105/4.1

(Continued)

FOREIGN PATENT DOCUMENTS

EP 1075407 A1 2/2001
EP 1190925 A1 3/2002

(Continued)

OTHER PUBLICATIONS

Railway applications—Ride comfort for passengers—Measurement and evaluation, British Standard, Apr. 2009,1-61.

*Primary Examiner* — Jason C Smith
(74) *Attorney, Agent, or Firm* — The Webb Law Firm

(57) ABSTRACT

A rail vehicle having a car body, which is supported on a running gear by a spring device, and a rolling compensation device, which is coupled to the running gear and the car body. The rolling compensation device may be arranged kinematically in parallel to the spring device. The rolling compensation device counteracts rolling motions of the car body toward the outside of the curve about a rolling axis during travel in curves. The rolling compensation device, in order to increase the tilting comfort, is designed to impose, in a first frequency range and under a first transverse deflection of the car body, upon the car body, a first rolling angle about the rolling axis, which corresponds to a current curvature of a current section of track being travelled.

20 Claims, 5 Drawing Sheets

U.S. PATENT DOCUMENTS

| | | | | |
|---|---|---|---|---|
| 5,943,962 | A * | 8/1999 | Birkhahn et al. | 105/199.2 |
| 5,970,883 | A * | 10/1999 | Nast | 105/164 |
| 6,131,520 | A * | 10/2000 | Dull | 105/199.2 |
| 6,244,190 | B1 * | 6/2001 | Sembtner et al. | 105/199.2 |
| 6,273,002 | B1 * | 8/2001 | Hachmann et al. | 105/199.1 |
| 6,457,420 | B2 * | 10/2002 | Laporte et al. | 105/456 |
| 6,786,159 | B2 * | 9/2004 | De Fleury et al. | 105/199.2 |
| 8,056,484 | B2 * | 11/2011 | Brundisch et al. | 105/199.2 |
| 2002/0035947 | A1 * | 3/2002 | Sebata et al. | 105/199.2 |
| 2005/0087098 | A1 * | 4/2005 | Streiter | 105/453 |
| 2012/0137926 | A1 * | 6/2012 | Schneider | 105/413 |

FOREIGN PATENT DOCUMENTS

| | | | |
|---|---|---|---|
| FR | 2231550 | A1 | 12/1974 |
| FR | 2232478 | A1 | 1/1975 |
| FR | 2633577 | A1 | 1/1990 |
| GB | 2079701 | A | 1/1982 |
| WO | 9003906 | A1 | 4/1990 |
| WO | 9956995 | A1 | 11/1999 |
| WO | 03043840 | A1 | 5/2003 |

* cited by examiner

VEHICLE HAVING ROLLING COMPENSATION

BACKGROUND OF THE INVENTION

1. Field of the Invention

The present invention relates to a vehicle, in particular a rail vehicle, having a car body, which is supported on a running gear in the direction of a vehicle height axis by means of a spring device, and a rolling compensation device, which is coupled to the running gear and the car body, wherein the rolling compensation device, in particular, is arranged kinematically in parallel to the spring device. The rolling compensation device counteracts rolling motions of the car body toward the outside of the curve about a rolling axis parallel to the vehicle longitudinal axis during travel in curves, wherein the rolling compensation device, for enhancing tilting comfort, is configured to impose, in a first frequency range under a first transverse deflection of the car body in the direction of a vehicle transverse axis, on the car body a first rolling angle, which corresponds to an actual curvature of a track section currently negotiated. The present invention also concerns a corresponding method for setting the rolling angle on a car body of a vehicle.

2. Description of Related Art

On rail vehicles—but also on other vehicles—the car body is generally supported on the wheel units, for example wheel pairs and wheelsets, via one or more spring stages. The centrifugal acceleration generated transversely to the direction of motion and thus to the vehicle longitudinal axis means that as a result of the comparatively high position of the centre of gravity of the car body the car body has a tendency to roll towards the outside of the curve in relation to the wheel units thus causing a rolling motion about a rolling axis parallel to the vehicle longitudinal axis.

Such rolling motions detract from the travel comfort when they exceed certain limiting values. In addition they also constitute a danger of breaching the permissible gauge profile and, in terms of the tilt stability and thus also the derailment safety, a danger of inadmissible unilateral wheel unloading. In order to prevent this, as a rule, rolling support mechanisms in the form of so-called rolling stabilisers are used. The job of these is to offer a resistance to the rolling motion of the car body in order to reduce the latter, but at the same time not hindering the rising and dipping motion of the car body in relation to the wheel units.

Such rolling stabilisers are known in various hydraulically or purely mechanically operating designs. Often a torsion shaft extending transversely to the vehicle longitudinal axis is used, as known from EP 1 075 407 B1, for example. On this torsion shaft, on either side of the vehicle longitudinal axis, levers secured against rotation are located, extending in the vehicle longitudinal direction. These levers are in turn connected to rods which are arranged kinematically in parallel with the suspension devices of the vehicle. When the springs of the suspension devices of the vehicle deflect, the levers located on the torsion shaft are set in a rotational motion by means of the rods to which they are connected.

If during travel in curves a rolling motion occurs with varying spring deflections of the suspension devices on either side of the vehicle, this results in differing angles of rotation of the levers located on the torsion shaft. The torsion shaft is thus loaded by a torsional moment, which—depending on its torsional stiffness—at a certain torsional angle, it compensates by a counter-moment resulting from its elastic deformation, thus preventing a further rolling motion. On rail vehicles fitted with bogies the rolling support mechanism can also be provided for the secondary suspension stage, i.e. between a running gear frame and the car body. The rolling support mechanism can also be applied in the primary stage, i.e. operating between the wheel units and a running gear frame or—in the absence of secondary suspension—a car body.

Such rolling stabilisers are also used in generic rail vehicles, such as those known from EP 1 190 925 A1. On the rail vehicle known from this document the upper ends of the two rods of the rolling stabilisers (in a plane running perpendicularly to the vehicle longitudinal axis) are displaced towards the centre of the vehicle. As a result of this the car body, in the event of a deflection in the vehicle transverse direction (as is caused, for example, by the centrifugal acceleration during travel in curves) is guided in such a way that a rolling motion of the car body toward the outside of the curve is counteracted and a rolling motion directed toward the inside of the curve is imposed upon it.

This rolling motion in the opposite direction serves, inter alia, to increase the so-called tilting comfort for the passengers in the vehicle. A high tilting comfort is normally understood here to be the fact that, during travel in curves, the passengers experience the lowest possible transverse acceleration in the transverse direction of their reference system, which as a rule is defined by the fixtures of the car body (floor, walls, seats, etc.). As a result of the tilting of the car body towards the inside of the curve caused by the rolling motion the passengers (depending on the degree of tilting) experience at least part of the transverse acceleration actually acting in the earth-fixed reference system merely as increased acceleration in the direction of the vehicle floor, which as a rule is perceived as less annoying or uncomfortable.

The maximum admissible values for the transverse acceleration acting in the reference system of the passengers (and, ultimately, the resultant setpoint values for the tilt angles of the car body) are as a rule specified by the operator of a rail vehicle. National and international standards (such as for example EN 12299) also provide a starting point for this.

Here, with the vehicle from EP 1 190 925 A1, it is possible to create a purely passive system, in which the components of the suspension and of the rolling stabilisers are adapted to each other in such a way that the desired tilting of the car body is achieved solely by the transverse acceleration acting during travel in curves.

For such a passive solution, firstly the rolling axis or the instantaneous centre of rotation of the rolling motion must be comparatively far above the centre of gravity of the car body. Secondly, the suspension in the transverse direction must be designed to be comparatively soft, in order to achieve the desired deflections solely with the acting centrifugal force. Such a transversely soft suspension also has a positive effect on the so-called vibration comfort in the transverse direction, since impacts in the transverse direction can be absorbed and dampened by the soft suspension.

These passive solutions have the disadvantage, however, that because of the transversely soft suspension and the elevated instantaneous centre of rotation in normal operation, but also in unplanned situations (e.g. an unexpected stopping of the vehicle on a curve with a high cant) comparatively high transverse deflections in the transverse direction also result meaning either that the typically specified gauge profile is breached or (in order to avoid this) only comparatively narrow car bodies with reduced transport capacity can be constructed.

The problem of large deflections in order to achieve a certain rolling angle can indeed be mitigated by shifting the rolling axis or the instantaneous centre of rotation. But this allows only even lower rolling angles to be achieved passively. Consequently the system stiffens in the transverse direction so that not only reductions in tilting comfort but also reductions in vibration comfort have to be accepted.

The rolling motion adjusted for the bend of the curve currently being traveled and the current running speed (and consequently also the resultant transverse acceleration) on the vehicle from EP 1 190 925 A1 can also be influenced or set actively by an actuator connected between the car body and the running gear frame. Here, from the current bend of the curve and the current vehicle speed, a setpoint value is calculated for the rolling angle of the car body, which is then used for setting the rolling angle by means of the actuator.

While this variant offers the opportunity of creating more transversely stiff systems with lower transverse deflection, it has the disadvantage that the vibration comfort is impaired by the transverse stiffness introduced by the actuator so that, for example, transverse impacts on the running gear (for example when travelling over switches or imperfections in the track) are transmitted to the car body with less damping.

In order to compensate for at least the disadvantages regarding vibration comfort by transversely stiff suspension, in WO 90/03906 A1 for a passive system it is proposed that, kinematically in series with the rolling compensation device, a comparatively short transverse supplementary suspension stage is introduced. The disadvantage of this solution, however, is that firstly due to the additional components it increases the installation space required, and secondly the problems described above of large transverse deflections or reduced transport capacity are present here again.

SUMMARY OF THE INVENTION

The object for the present invention was therefore to provide a vehicle or a method of the type mentioned initially, which does not have, or only to a limited extent, the disadvantages mentioned above and in particular which, in a simple and reliable manner allows a high travel comfort for passengers with a high transport capacity of the vehicle.

The present invention solves this problem on the basis of a vehicle according to the preamble of claim 1 by means of the features indicated in the characterising part of claim 1. It also solves this problem on the basis of a method according to the preamble of claim 17 by means of the features indicated in the characterising part of claim 17.

The present invention is based on the technical teaching that, in a simple and reliable manner, a high travel comfort for the passengers with high transport capacity of the vehicle is made possible by selecting an active solution with an active rolling compensation device, which imposes upon the car body in a second frequency range, which at least partially lies above the first frequency range, a second transverse deflection (as the case may be, therefore, also a second rolling angle about the rolling axis). In this way, the transverse deflection resulting from the first rolling angle, the setting of which ultimately represents a quasi-static adaptation of the rolling angle and thus the transverse deflection to the current track curvature and the current speed, can be overlaid with a second transverse deflection (as the case may be, therefore, also a second rolling angle), the setting of which ultimately represents a dynamic adaptation to current disturbances introduced into the car body.

While by means of the first rolling angle and thus the first transverse deflection in the first frequency range, an increase in the tilting comfort is achieved, by means of the second transverse deflection (and as the case may be the second rolling angle) in the second frequency range (which at least partially lies above the first frequency range) in an advantageous manner an increase in the vibration comfort is achieved. By the design of the rolling compensation device as an active system in at least the second frequency range, in an advantageous manner it is possible to design the support of the car body on the running gear in the transverse direction of the vehicle to be comparatively stiff, in particular to position the rolling axis or the instantaneous centre of rotation of the car body comparatively close to the centre of gravity of the car body, so that firstly the desired rolling angle is associated with relatively low transverse deflections and secondly in the event of a failure of the active components the most passive possible restoration of the car body to a neutral position is possible. These low transverse deflections in normal operation and the passive restoration in the event of a fault allow in an advantageous manner particularly broad car bodies with a high transport capacity to be built.

In this connection it is noted that the second transverse deflection, depending on the design and the connection of the rolling compensation device, as the case may be, does not necessarily have to be associated with a second rolling angle corresponding to the (static) kinematics of the rolling compensation device, which is overlaid on the first rolling angle in the second frequency range. This is because, for example with a comparatively soft, elastic connection of the rolling compensation device to the running gear and/or the car body, as a result of the forces of inertia in the second frequency range, within certain limits a kinematic decoupling of the transverse movements of the car body from the rolling motion specified by the kinematics of the rolling compensation device (for slow, quasi-static motions) occurs. Therefore, the more rigidly the connection of the rolling compensation device to the running gear is created and the more inherently rigid the design of the rolling compensation device is, the less this decoupling takes place. Therefore, the first rolling angle, in a design with a rigid coupling to an inherently rigid rolling compensation device, in the second frequency range is ultimately overlaid by a second rolling angle.

According to a first aspect, the invention hence relates to a vehicle, in particular a rail vehicle, having a car body, which is supported on a running gear in the direction of a vehicle height axis by means of a spring device, and a rolling compensation device, which is coupled to the running gear and the car body. The rolling compensation device, in particular, can be arranged kinematically in parallel to the spring device. The rolling compensation device counteracts rolling motions of the car body toward the outside of the curve about a rolling axis parallel to the vehicle longitudinal axis during travel in curves. The rolling compensation device, in order to increase the tilting comfort, is designed such that it imposes on the car body, in a first frequency range under a first transverse deflection of the car body in the direction of the vehicle transverse axis, a first rolling angle about the rolling axis, which corresponds to a current curvature of a current section of track being traveled. Furthermore, the rolling compensation device, in order to increase the vibration comfort, is designed such that it imposes on the car body, in a second frequency range, a second transverse deflection overlaid on the first transverse deflection, wherein the second frequency range at least partially, in particular completely, lies above the first frequency range.

The rolling compensation device can thus be designed such that it is active only in the second frequency range, and thus only actively sets the second transverse deflection or, as the case may be, the second rolling angle, while the setting of the first rolling angle is brought about purely passively as a result of the transverse acceleration or the resulting centrifugal force acting on the car body during travel in curves. It is similarly possible, however, in both frequency ranges, to bring about an at least partially active setting of the rolling angle and the transverse deflection, respectively, by means of the rolling compensation device, which is, as the case may be, supported by the centrifugal force. Finally, it can also be provided that the setting of the rolling angle or the transverse deflection is performed exclusively actively by means of the rolling compensation device. This is the case if the rolling axis or the instantaneous centre of rotation of the car body is positioned at or near the centre of gravity of the car body, so that the centrifugal force cannot make any (or at least no significant) contribution to the generation of the rolling motion and the transverse deflection, respectively.

The rolling compensation device can basically be designed in any manner. The rolling compensation device preferably comprises an actuator device with at least one actuator unit controlled by a control device, the actuator force of which provides at least part of the force for setting the rolling angle or the transverse deflection on the car body. With an at least partially active setting of the rolling angle or the transverse deflection in the first frequency range, the actuator device is designed to make at least a majority contribution to the generation of the first rolling angle in the first frequency range, in particular, to substantially generate the first rolling angle and the first transverse deflection, respectively.

The first frequency range, preferably, is the frequency range in which quasi static rolling motions corresponding to the current curvature of the section of track being traveled and the current running speed. This frequency range can vary according to the requirements of the rail network and/or the vehicle operator (for example due to the use of the vehicle for local travel or long-distance travel, in particular high-speed travel). The first frequency range preferably ranges from 0 Hz to 2 Hz, preferably from 0.5 Hz to 1.0 Hz. The same applies to the bandwidth of the second frequency range, wherein this is of course matched to the dynamic disturbances to be expected during operation of the vehicle (as the case may be periodic, but typically singular or statistically scattered), which are noticed by the passengers and perceived as annoying. The second frequency range therefore preferably ranges from 0.5 Hz to 15 Hz, preferably from 1.0 Hz to 6.0 Hz.

Basically it can be provided that the active setting that takes place (at least in the second frequency range) of the rolling angle and the transverse deflection, respectively, takes place via the rolling compensation device exclusively during travel in curves on the curved track, and therefore the rolling compensation device is active only in such a travel situation. Preferably, it is however provided that the rolling compensation device is also active during straight travel, so that the vibration comfort in an advantageous manner is also guaranteed in these travel situations.

In preferred variants of the vehicle according to the invention, by means of the rolling compensation device, a limitation of the transverse deflections of the car body (thus the deflections in the vehicle transverse direction) in relation to a neutral position is carried out. The neutral position is defined by the position of the car body which it adopts when the vehicle is at a standstill on a straight and level track. In this way it is possible in an advantageous way, to build particularly wide car bodies with high transport capacity, which are matched to the gauge profile specified by the operator of the rail vehicle. The limitation of the transverse deflections can be performed by any suitable components of the rolling compensation device. Preferably, an actuator device of the rolling compensation device provides the limitation of the transverse deflections, since in this way a particularly compact, space-saving design can be achieved.

As mentioned, the limitation of the transverse deflections can be matched to the gauge profile specified by the operator of the vehicle. Particularly advantageous designs result if the rolling compensation device, in particular an actuator device of the rolling compensation device, is designed in such a way that a first maximum transverse deflection of the car body from the neutral position occurring toward the outside of the curve during travel in curves in the vehicle transverse direction is limited to 80 mm to 150 mm, preferably 100 mm to 120 mm. While, with regard to complying with the specified gauge profile, limitation of the transverse deflections in vehicles with (in the longitudinal direction of the vehicle) running gears arranged centrally below the car bodies is of particular importance, in vehicles with running gears arranged in the end area of the car bodies it is of particular interest to correspondingly limit the transverse deflections toward the inside of the curve. Preferably, therefore, additionally or alternatively, a second maximum transverse deflection of the car body from the neutral position occurring toward the inside of the curve during travel in curves in the vehicle transverse direction is limited to 0 mm to 40 mm, preferably 20 mm. It is self-evident that, with certain variants of the invention, it can also be provided that a second maximum transverse deflection of the car body from the neutral position toward the inside of the curve during travel in curves can also have a negative value, for example −20 mm. In this case the car body will therefore also be deflected on the inside of the curve to the outside of the curve, in order, for example, to adhere to a specified gauge profile with particularly wide car bodies.

As already mentioned, the limitation of the transverse deflections can preferably be performed by an actuator device of the rolling compensation device. Here it is preferably provided that the actuator device is designed to act as an end stop device for definition of at least one end stop for the rolling motion of the car body. To this end, a stop defined by the design of the actuator device (for example a simple mechanical stop) can be provided. Preferably, the actuator device is designed to define the position of the at least one end stop for the rolling motion of the car body in a variable fashion. In other words, it can be provided that this stop by actively restraining the actuator device (for example by corresponding energy provision to the actuator device) and/or passively restraining the actuator device (for example by deactivating a self-restraining design actuator device) is freely definable at any position in the adjusting path of the actuator device.

The actuator device of the rolling compensation device can basically be designed in any suitable manner. Preferably, it is provided that the actuator device in the event of its inactivity offers at most only slight resistance, in particular substantially no resistance, to a rolling motion of the car body. Consequently the actuator device is preferably not designed to be self-restraining, so that in the event of a failure of the actuator device inter alia a restoration of the car body to its neutral position is ensured.

In preferred variants of the vehicle according to the invention the rolling compensation device is designed in such a way that, even in the event of failure of the active components of the rolling compensation device, emergency operation of the vehicle with, as the case may be, degraded comfort characteristics (in particular with regard to tilting comfort and/or vibration comfort) is still possible while complying with the specified gauge profile.

Preferably, therefore, it is provided that the spring device, when an actuator device of the rolling compensation device is inactive, exerts a restoring moment on the car body about the rolling axis, wherein the restoring moment is dimensioned such that, in the event of an inactive actuator device, a transverse deflection of the car body from the neutral position for a stationary vehicle under a nominal loading of the car body and with a maximum permitted track superelvation is less than 10 mm to 40 mm, preferably less than 20 mm. In other words, the spring device (in particular its stiffness in the vehicle transverse direction) is preferably designed so that a vehicle which for any reason (for example due to damage to the vehicle or to the track) comes to a standstill at an unfavourable spot, as before complies with the specified gauge profile.

Additionally or alternatively it can be provided that the restoring moment in the event of an inactive actuator device is dimensioned such that a transverse deflection of the car body from the neutral position, under nominal loading of the car body and with a maximum permitted transverse acceleration of the vehicle acting in the direction of a vehicle transverse axis, is less than 40 mm to 80 mm, preferably less than 60 mm. In other words the spring device (in particular its stiffness in the vehicle transverse direction) is preferably designed so that a vehicle, in emergency operation in the event of failure of the actuator device, when travelling at normal running speed, as before complies with the specified gauge profile.

The stiffness, in particular the transverse stiffness in the vehicle transverse direction, of the support of the car body on the running gear can have any suitable characteristic as a function of the transverse deflection. Thus, for example, a linear or even progressive behaviour of the stiffness as a function of the transverse deflection can be provided. Preferably, however, a degressive behaviour is provided so that an initial transverse deflection of the car body from the neutral position experiences a comparatively high resistance, this resistance decreasing however as the deflection increases. With regard to the dynamic setting of the second rolling angle in the second frequency range during travel in curves, this is an advantage, however, since the rolling compensation device has to make available lower forces for these dynamic deflections in the second frequency range.

It is preferably provided, therefore, that the spring device defines a restoring characteristic line, wherein the restoring characteristic line represents the dependence of the restoring moment on the rolling angle deflection and the restoring characteristic line has a degressive behaviour. The behaviour of the restoring characteristic line here can basically be adapted in any suitable manner to the current application. Preferably, the restoring characteristic line, in a first rolling angle range and a first transverse deflection range, respectively, has a first inclination and, in a rolling angle range above the first rolling angle range and a transverse deflection range above the first transverse deflection range, respectively, has a second inclination that is less than the first inclination, wherein the ratio of the second inclination to the first inclination is in particular in the range from 0 to 1, preferably in the range from 0 to 0.5. The two rolling angle ranges and transverse deflection ranges, respectively, can be selected in any suitable manner. Preferably, the first transverse deflection range ranges from 0 mm to 60 mm, preferably from 0 mm to 40 mm, and the second transverse deflection range, in particular, ranges from 20 mm to 120 mm, preferably from 40 mm to 100 mm. The rolling angle ranges, as a function of the given kinematics, then correspond to the transverse deflection ranges.

Here it is self-evident that the determination of the characteristic of the spring device is predominantly directed towards the transverse deflections, which, in the event of a failure of active components, should still be achieved. The first inclination here, as a rule, defines the residual transverse deflection in the event of failure of an active component, while the second inclination determines the actuator forces for larger deflections and is, as far as possible, selected such that these actuator forces in the event of large deflections can be kept low. The second inclination is therefore preferably kept as close as possible to the value of zero. As the case may be negative values of the second inclination are even possible or may be provided.

In order to achieve the described restoring of the car body to its neutral position, the support for the car body on the running gear can have any suitable stiffness. Here a stiffness that is substantially independent of the transverse deflection can be provided for. Preferably, however, it is again provided that the spring device has a transverse stiffness in the direction of a vehicle transverse axis, which is dependent upon a transverse deflection of the car body from the neutral position in the direction of the vehicle transverse axis, so that for deflections in the vicinity of the neutral position another stiffness (for example a higher stiffness) prevails than in the area of larger deflections. In this way the advantages described above in terms of dynamic setting of the second rolling angle during travel in curves can again be achieved.

The spring device, preferably, in a first transverse deflection range, has a first transverse stiffness, while, in a second transverse deflection range above the first transverse deflection range, it has a second transverse stiffness, which is lower than the first transverse stiffness. Here it is self-evident that the transverse stiffness can vary within the respective transverse deflection range. In addition, the behaviour of the transverse stiffness according to the transverse deflection can basically be adapted in any suitable manner for the current application.

Preferably, the first transverse stiffness is in the range 100 N/mm to 800 N/mm, further preferably in the range 300 N/mm to 500 N/mm, while the second transverse stiffness is preferably in the range 0 N/mm to 300 N/mm, further preferably in the range 0 N/mm to 100 N/mm. The two transverse deflection ranges can likewise be selected in any suitable manner adapted to the respective application. The first transverse deflection range preferably ranges from 0 mm to 60 mm, preferably from 0 mm to 40 mm, while the second transverse deflection range preferably ranges from 20 mm to 120 mm, further preferably from 40 mm to 100 mm. In this way, with regard to a limitation of the maximum transverse deflection of the car body with the lowest possible use of energy, particularly good designs can be achieved.

The advantageous behaviour of the vehicle already described above in the absence of one or more active components of the rolling compensation device can preferably be achieved by means of a corresponding design of the spring device, in particular of its transverse stiffness.

Preferably, therefore, for a favourable behaviour in such emergency operation of the vehicle, it is provided that the spring device in the direction of a vehicle transverse axis has a transverse stiffness, wherein the transverse stiffness of the spring device is dimensioned such that, in the event of inactivity of an actuator device of the rolling compensation device during travel in curves with a maximum permissible transverse acceleration of the vehicle operating in the direction of a vehicle transverse axis, a first maximum transverse deflection of the car body from the neutral position toward the outside of the curve in a vehicle transverse direction is limited to 40 mm to 120 mm, preferably to 60 mm to 80 mm. Additionally or alternatively it is provided that a second maximum transverse deflection of the car body from the neutral position toward the inside of the curve in a vehicle transverse direction is limited to 0 mm to 60 mm, preferably to 20 mm to 40 mm.

The rolling angle ranges then again, as a function of the given kinematics, correspond to the above transverse deflection ranges.

Furthermore, additionally or alternatively, (with regard to a favourable behaviour for a stationary vehicle) it can be provided that the transverse stiffness of the spring device is dimensioned such that, in the event of inactivity of an actuator device of the rolling compensation device, a transverse deflection (and, thus, a corresponding rolling angle deflection) of the car body from the neutral position under nominal loading and with a maximum permitted track superelevation is less than 10 mm to 40 mm, preferably less than 20 mm.

The active components of the rolling compensation device can basically be designed in any way. Preferably, (as already mentioned) at least one actuator device is provided, which is connected between the car body and the running gear and performs the setting of the rolling angle in the second frequency range. Due to their particularly simple and robust design, preference is for the use of linear actuators, for which, preferably, the travel and the actuator forces are limited in a suitable manner in order to meet the dynamics requirements of the setting of the transverse deflection and the rolling angle in the second frequency range, respectively, with satisfactory results.

In variants of the vehicle according to the invention with particularly favourable dynamic properties, the rolling compensation device is designed in such a way that an actuator device of the rolling compensation device, in the first frequency range, has a maximum deflection from the neutral position of 60 mm to 110 mm, preferably 70 mm to 85 mm, while, additionally or alternatively, in the second frequency range, from a starting position, it has a maximum deflection of 10 mm to 30 mm, preferably 10 mm to 20 mm. Furthermore, with regard to the maximum actuator force, it can be provided that the actuator device, in the first frequency range, exerts a maximum actuator force of 10 kN to 40 kN, preferably 15 kN to 30 kN, while, in the second frequency range, it exerts a maximum actuator force of 5 kN to 35 kN, preferably 5 kN to 20 kN.

In preferred variants of the vehicle according to the invention, the distance (in the neutral position of the car body) between the rolling axis of the car body and the centre of gravity of the car body in the direction of the vehicle height axis is adapted to the respective application. Thus, the centre of gravity of the car body, as a rule, has a first height (H1) above the track (typically above the upper surface of the rail SOK), while the rolling axis, in the neutral position, in the direction of the vehicle height axis has a second height (H2) above the track. Preferably, the ratio of the difference between the second height and the first height (H2 to H1) to the first height (H1) is a maximum of 2.2, preferably a maximum of 1.3, further preferably 0.8 to 1.3. The difference between the second height and the first height (H2–H1), in particular, can be between 1.5 m and 4.5 m, preferably 1.8 m. This allows designs to be realized which, with regard to the limitation of the transverse deflections already mentioned above and thus the feasibility of wide car bodies with high transport capacity, are particularly favourable.

The rolling compensation device can basically be designed in any suitable manner, in order to carry out the setting of the rolling angle of the car body in the two frequency ranges. In particularly simple design variants of the vehicle according to the invention it is provided to this end that the rolling compensation device comprises a rolling support device, which is arranged kinematically in parallel to the spring device and is designed to counteract rolling motions of the car body about the rolling axis when travelling in a straight track. Such rolling support devices are sufficiently known, and so no further details of them will be provided here. They can in particular be based on differing operating principles. Thus, they may be based on a mechanical operating principle. But fluidic (for example hydraulic) solutions, electromechanical solutions or any combination of all these operating principles are also possible.

In a particularly simple design variant, the rolling support device comprises two rods, each of which at one end is connected in an articulated manner to the car body and each of which at the other end is connected in an articulated manner to opposing ends of a torsion element, which is supported by the running gear, as has already been described at the outset.

Additionally or alternatively the rolling compensation device can also comprise a guiding device, which is arranged kinematically in series with the spring device. The guiding device comprises a guiding element, which is arranged between the running gear and the car body and is designed such that, during rolling motions of the car body, it defines a motion of the guiding element in relation to the car body or the running gear. Again, the guiding device can have any suitable design in order to perform the guidance described. Thus it can for example be created with the sliding and/or rolling of the guiding element on a guideway.

In particularly simply designed and robust variants of the vehicle according to the invention the guiding device, in particular, comprises at least one multilayered spring. The multilayered spring can be created as a simple rubber multilayered spring, the layers of which are arranged to be inclined with respect to the vehicle height axis and to the vehicle transverse axis, so that they define the rolling axis of the car body.

Here, it is pointed out that the design of the rolling compensation device with such a multilayered spring device for definition of the rolling axis of the car body constitutes an individually patentable inventive idea, which is, in particular, independent of the setting described above of the rolling angle in the first frequency range and the second frequency range.

The present invention can be used in association with any designs of the support of the car body on the running gear. Thus, for example, it can be used in connection with a single stage suspension, which supports the car body directly on the wheel unit. Particularly advantageously it can be used in connection with two-stage suspension designs. Preferably, the running gear accordingly comprises at least one running gear frame and least one wheel unit, while the spring device has a primary suspension and a secondary suspension. The running gear frame is supported via the primary suspension on the wheel unit, while the car body is supported via the secondary suspension, which is, in particular, designed as pneumatic suspension, on the running gear frame. The rolling compensation device is then preferably arranged kinematically in parallel to the secondary suspension between the running gear frame and the car body. This allows integration into the majority of vehicles typically used.

The stiffness of the spring device, in particular, its transverse stiffness can, as the case may be, be determined solely by the primary suspension and the secondary suspension. In particular, the spring device comprises a transverse spring device, which, in an advantageous manner, serves to adapt or optimise the transverse stiffness of the spring device for the respective application. This simplifies the design of the spring device considerably despite the simple optimisation of the transverse stiffness. The transverse spring device can be connected at one end to the running gear frame and at the other end to the car body. Additionally or alternatively the transverse spring device can also be connected at one end to the running gear frame or to the car body and at the other to the rolling compensation device.

The transverse spring device is preferably designed to increase the stiffness of the spring device in the direction of the vehicle transverse axis. Here it can have any characteristic adapted for the respective application. The transverse spring device, preferably, has a degressive stiffness characteristic, in order to achieve an overall degressive stiffness characteristic of the spring device.

In preferred examples of the vehicle according to the invention it is further provided that the spring device has an emergency spring device, which is arranged centrally on the running gear, in order that, even if the supporting components of the spring device fail, emergency operation of the vehicle is possible. The emergency spring device can basically be designed in any manner. Preferably the emergency spring device is designed such that it supports the compensation effect of the rolling compensation device. To this end, the emergency spring device can comprise a sliding or rolling guide which follows the compensation motion.

The present invention also relates to a method for setting a rolling angle on a car body of a vehicle, in particular a rail vehicle, supported via a spring device on a running gear about a rolling axis parallel to the vehicle longitudinal axis of the vehicle, in which the rolling angle is actively set. During travel in curves, rolling motions of the car body toward the outside of the curve about a rolling axis parallel to the vehicle longitudinal axis are counteracted, wherein, for enhancing tilting comfort, in a first frequency range under a first transverse deflection of the car body in the direction of a vehicle transverse axis, a first rolling angle is imposed of the car body, which corresponds to an actual curvature of a track section currently negotiated. For enhancing vibration comfort, a second transverse deflection overlaid on the first transverse deflection is imposed on the car body in a second frequency range, which lies at least partially, in particular completely, above the first frequency range. In this way the variants and advantages described above in connection with the vehicle according to the invention can be achieved to the same extent, so that in this context reference is made to the above statements.

BRIEF DESCRIPTION OF THE DRAWINGS

Further preferred examples of the invention become apparent from the dependent claims or the following description of preferred embodiments which refers to the attached drawings. It is shown in:

DETAILED DESCRIPTION OF THE INVENTION

First Embodiment

In the following, by reference to FIGS. 1 to 5, a first preferred embodiment of the vehicle according to the invention in the form of a rail vehicle 101, having a vehicle longitudinal axis 101.1, is described.

Figure 1:
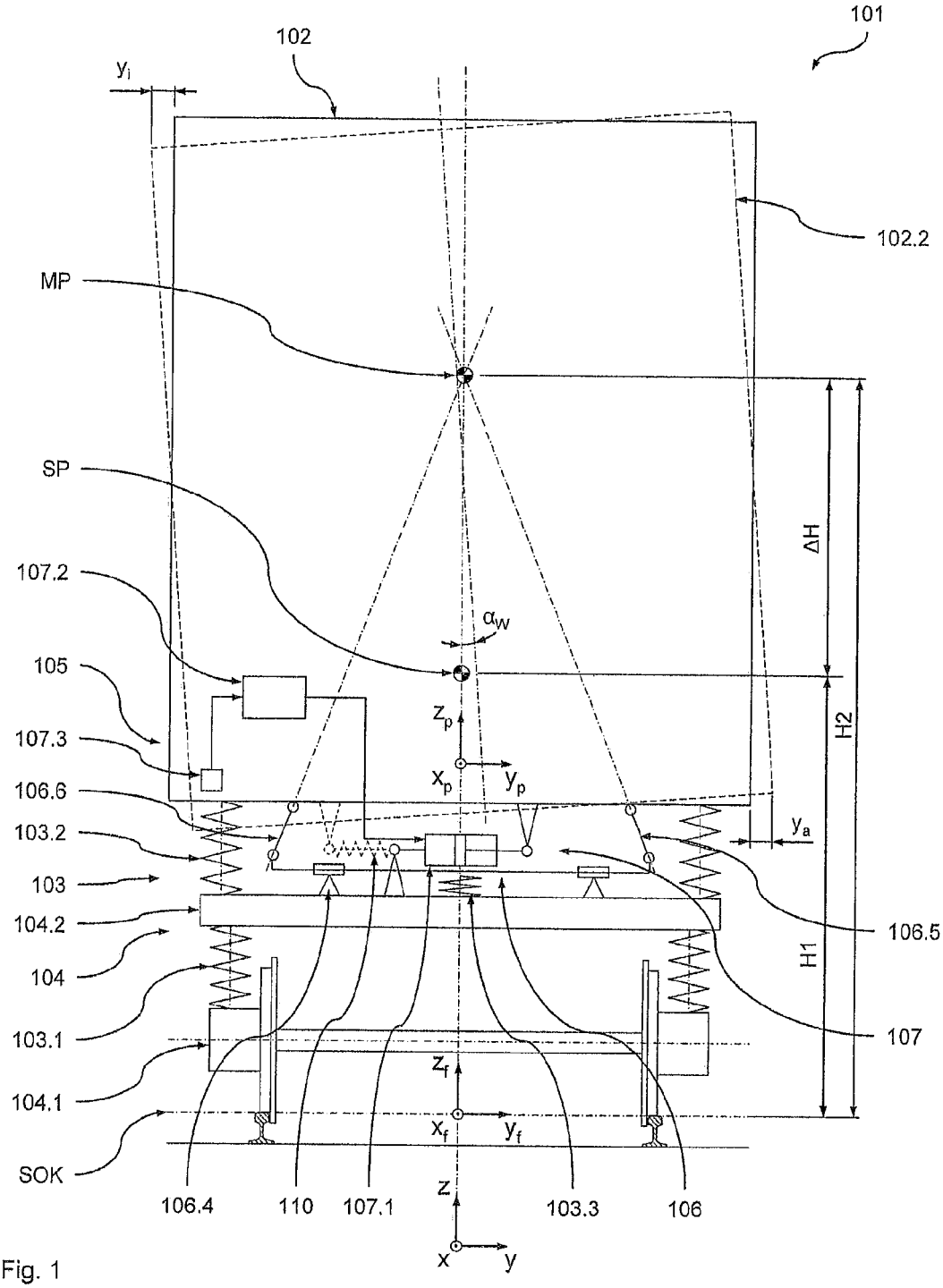
FIG. 1 a schematic sectional view of a preferred embodiment of the vehicle according to the invention in the neutral position (along the line I-I from FIG. 3)

FIG. 1 shows a schematic sectional view of the vehicle 101 in a sectional plane perpendicular to the vehicle longitudinal axis 101.1. The vehicle 101 comprises a car body 102, which in the area of its ends is supported by means of a spring device 103 on a running gear in the form of a bogie 104. It is self-evident, however, that the present invention can also be used with other configurations in which the car body is supported only on one running gear.

For ease of understanding of the explanations that follow, in the figures a vehicle coordinate system $x_f$, $y_f$, $z_f$ (determined by the wheel contact plane of the bogie 104) is indicated, in which the $x_f$ coordinate denotes the longitudinal direction of the rail vehicle 101, the $y_f$ coordinate the transverse direction of the rail vehicle 101 and the $z_f$ coordinate the perpendicular direction of the rail vehicle 101. Additionally an absolute coordinate system x, y, z (determined by the direction of the gravitational force) and a passenger coordinate system $x_p$, $y_p$, $z_p$ (determined by the car body 102) are defined.

The bogie 104 comprises two wheel units in the form of wheelsets 104.1, each of which via the primary suspension 103.1 of the spring device 103 supports a bogie frame 104.2. The car body 102 is again supported via a secondary suspension 103.2 on the bogie frame 104.2. The primary suspension 103.1 and the secondary suspension 103.2 are shown in simplified form in FIG. 1 as helical springs. It is self-evident, however, that the primary suspension 103.1 or the secondary suspension 103.2, can be any suitable spring device. In particular, the secondary suspension 103.2 preferably is a pneumatic suspension or similar that is sufficiently well known.

The vehicle 101 also comprises in the area of each bogie 104 a rolling compensation device 105, which works kinematically in parallel with the secondary suspension 103.2 between the bogie frame 104.2 and the car body 102 in the manner described in more detail below.

Figure 4:
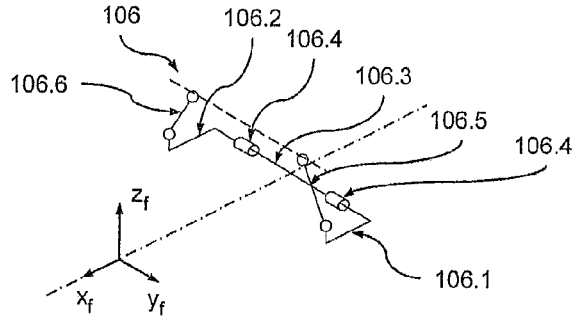
FIG. 4 a schematic perspective view of part of the vehicle from FIG. 1.

As can be inferred, in particular, from FIG. 1, the rolling compensation device 105 comprises a sufficiently known rolling support 106, which on the one hand is connected with the bogie frame 104.2 and on the other with the car body 102. FIG. 4 shows a perspective view of this rolling support 106. As can be inferred from FIG. 1 and FIG. 4, the rolling support 106 comprises a torsion arm in the form of a first lever 106.1 and a second torsion arm in the form of a second lever 106.2. The two levers 106.1 and 106.2 are located on either side of the longitudinal central plane ($x_f$,$z_f$-plane) of the vehicle 101 in each case secured against rotation on the ends of a torsion shaft 106.3 of the rolling support 106. The torsion shaft 106.3 extends in the transverse direction ($y_f$-direction) of the vehicle and is rotatably supported in bearing blocks 106.4, which for their part are firmly attached to the bogie frame 104.2. At the free end of the first lever 106.1 a first rod 106.5 is attached in an articulated manner, while on the free end of the second lever 106.2 a second rod 106.6 is attached in an articulated manner. By means of these two rods 106.5, 106.6 the rolling support 106 is connected in an articulated manner with the car body 102.

In FIGS. 1 and 4 the state in the neutral position of the vehicle 101 is shown, which results from travelling on a straight track 108 with no twists. In this neutral position the two rods 106.5, 106.6 run in the drawing plane of FIG. 1 ($y_f$,$z_f$ plane), in the present example inclined to the height axis ($z_f$ axis) of the vehicle 101 in such a way that their top ends (connected in an articulated manner to the car body 102) are displaced towards the centre of the vehicle and their longitudinal axes intersect at a point MP, which lies in the longitudinal central plane ($x_f$,$z_f$-plane) of the vehicle. By means of the rods 106.5, 106.6 in a sufficiently known manner a rolling axis running parallel to the vehicle longitudinal axis 101.1 (in the neutral position) is defined which runs through the point MP. The point of intersection MP of the longitudinal axes of the rods 106.5, 106.6 in other words constitutes the instantaneous centre of rotation of a rolling motion of the car body 102 about this rolling axis.

The rolling support 106 allows in a sufficiently known manner synchronous dip by the secondary suspension 103.2 on either side of the vehicle, while preventing a pure rolling motion about the rolling axis or the instantaneous centre of rotation MP. Furthermore, as can be inferred in particular from FIG. 2, because of the inclination of the rods 106.5, 106.6 the rolling support 106 kinematics with a combined motion of a rolling motion about the rolling axis or the instantaneous centre of rotation MP and a transverse motion in the direction of the vehicle transverse axis ($y_f$ axis) is predefined. Here, it is self-evident that the point of intersection MP and thus the rolling axis because of the kinematics predefined by the rods 106.5, 106.6, when there is a deflection of the car body 102 from the neutral position, as a rule will likewise experience a lateral shift.

Figure 2:
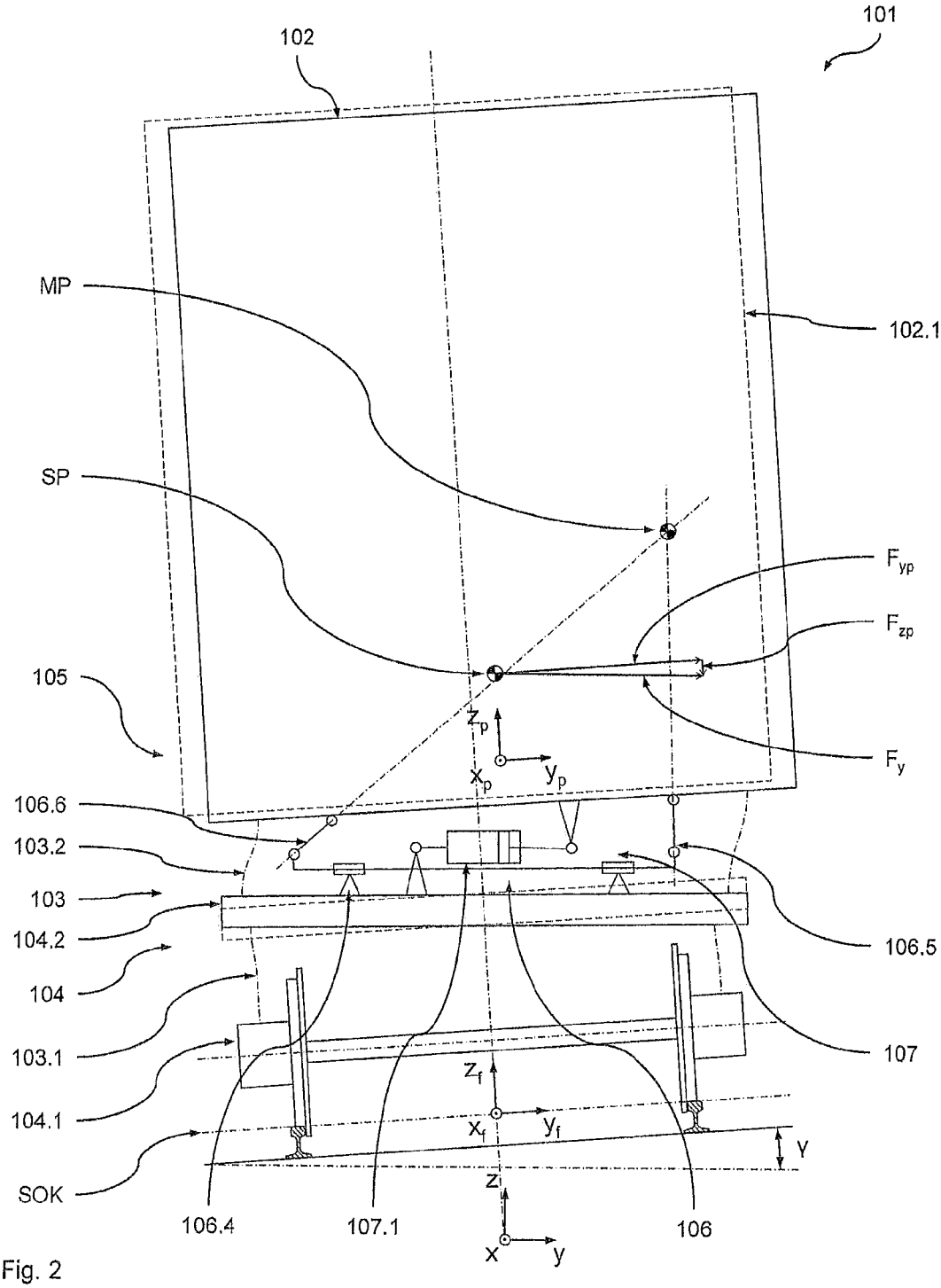
FIG. 2 a schematic sectional view of the vehicle from FIG. 1 during travel in curves.
Figure 3:
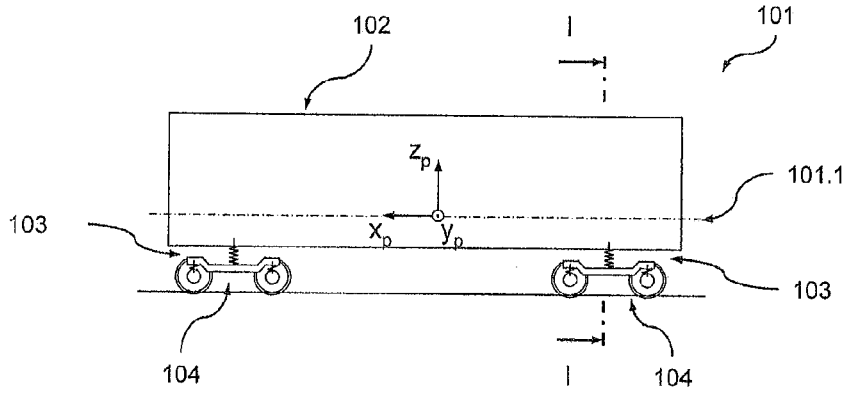
FIG. 3 a schematic side view of the vehicle from FIG. 1.

FIG. 2 shows the vehicle 101 during travel in curves on a track superelevation. As can be inferred from FIG. 2, the centrifugal force $F_y$ acting upon the centre of gravity SP of the car body 102 (because of the prevailing acceleration in the vehicle transverse direction) causes on the bogie frame 104.2 a rolling motion toward the outside of the curve, which results from a larger dip of the primary suspension 103.1 on the outside of the curve.

As can further be inferred from FIG. 2, the described design of the rolling support 106 during the travel in curves of the vehicle 101 in the area of the secondary suspension 103.2 brings about a compensation motion, which counteracts the rolling motion of the car body 102 (in relation to the neutral position indicated by the broken contour 102.1 on a straight, level track) toward the outside of the curve, which in the absence of the rolling support 106 because of the centrifugal force impinging on the centre of gravity SP of the car body 102 (similar to uneven suspension by the primary suspension 103.1) would arise from larger dip of the secondary suspension 103.2 on the outside of the curve.

Thanks to this compensation motion that is predefined by the kinematics of the rolling support 106, inter alia the tilting comfort for the passengers in the vehicle 101 is increased, since the passengers (in their reference system $x_p$, $y_p$, $z_p$ defined by the car body 102) notice a part of the transverse acceleration $a_y$ or centrifugal force $F_y$ currently acting in the earth-fixed reference system merely as an increased acceleration component $a_{zp}$ and force action $F_{zp}$, respectively, in the direction of the floor of the car body 102, which as a rule is perceived as less annoying or uncomfortable. The transverse acceleration component $a_{yp}$ and centrifugal component $F_{yp}$, respectively, acting in the transverse direction perceived by passengers in their reference system as annoying is thus recued in an advantageous manner.

The maximum permitted values for the transverse acceleration $a_{yp,max}$ acting in the reference system ($x_p$, $y_p$, $z_p$) for passengers are as a rule specified by the operator of the vehicle 101. The starting points for this are also provided by national and international standards (such as for example EN 12299).

The transverse acceleration $a_{yp}$ acting in the reference system ($x_p$, $y_p$, $z_p$) for passengers (in the direction of the $y_p$ axis) is comprised two components, namely a first acceleration component $a_{yps}$ and a second acceleration component $a_{ypd}$ according to the equation:

$$a_{yp}=a_{yps}+a_{ypd}. \tag{1}$$

The current value of the first acceleration component $a_{yps}$ is a result of travelling the current curve at the current running speed, while the current value of the second acceleration component $a_{ypd}$ is the result of current (periodic or usually singular) events (such as for example passing a disruptive part of the track, such as switches or similar).

Since the curvature of the curve and the current running speed of the vehicle 101 in normal operation change only comparatively slowly, with this first acceleration component $a_{yps}$ is a quasi static component. Conversely, the second acceleration component $a_{ypd}$ (which usually occurs as a result of impacts) is a dynamic component.

From the current transverse acceleration $a_{yp}$, according to the present invention it is ultimately possible to determine a minimum setpoint value for a transverse deflection $dy_{N,soll,min}$ of the car body 102 from the vehicle height axis ($z_f$ axis). This is the transverse deflection (and thus as the case may be the corresponding rolling angle), which is the minimum necessary in order keep below the maximum permissible transverse acceleration $a_{yp,\,max}$. Depending on how high the level of comfort for the passengers of the vehicle 101 must be (and thus depending on by how far this maximum permissible transverse acceleration $a_{yp,\,max}$ it should be kept below), a setpoint value for the transverse deflection $dy_{w,\,soll}$ of the car body 102 in the direction of the vehicle transverse axis ($y_f$ axis) can be specified, which corresponds to the current vehicle state. Here, this setpoint value for the transverse deflection $dy_{w,\,soll}$ of the car body 102 again comprises a quasi static component $dy_{Ws,\ soll}$ and a dynamic component $dy_{Wd,soll}$, wherein the following applies:

$$dy_{W,soll}=dy_{Ws,soll}+dy_{Wd,soll}. \tag{2}$$

The quasi static component $dY_{Ws,soll}$ is the quasi static setpoint value for the transverse deflection (and thus the rolling angle) that is relevant for tilting comfort and which is determined by the current quasi static transverse acceleration $a_{yps}$ (which in turn is dependent upon the curvature of the curve and the current running speed v). Therefore, here it is the setpoint value for the transverse deflection, as is the case with vehicles known from the state of the art with active setting of the rolling angle for regulation of the rolling angle.

The dynamic component $dy_{Wd,soll}$ on the other hand is the dynamic setpoint value for the transverse deflection (and thus as the case may be also for the rolling angle) relevant for the vibration comfort, which is the result of the current dynamic transverse acceleration $a_{ypd}$ (which in turn is caused by periodic or singular disturbances on the track).

In order to actively set the transverse deflection $dy_w$ of the car body 102 with respect to the neutral position (as shown in FIG. 1 by the broken contour 102.2), the rolling compensation device 105 in the present example also has an actuator device 107, which for its part comprises an actuator 107.1 and an associated control device 107.2. The actuator 107.1 is connected at one end in an articulated fashion with the bogie frame 104.2 and at the other in an articulated fashion with the car body 102.

In the present example the actuator 107.1 is designed as an electro-hydraulic actuator. It is self-evident, however, that with other variants of the invention an actuator can also be used that works according to any other suitable principle. Thus for example hydraulic, pneumatic, electrical and electromechanical operating principles can be used singly or in any combination.

The actuator 107.1 in the present example is arranged in such a way that the actuator force exerted by it between the bogie frame 104.2 and the car body 102 (in the neutral position) acts parallel to the vehicle transverse direction ($y_f$ direction). It is self-evident, however, that with other variants of the invention another arrangement of the actuator can be provided, provided that the actuator force exerted by it between the running gear and the car body has a component in the vehicle transverse direction.

The control device 107.2 controls or regulates the actuator force and/or the deflection of the actuator 107.1 according to the present invention in such a way that a quasi static first transverse deflection $dy_{Ws}$ of the car body 102 and a dynamic second transverse deflection $dy_{Wd}$ of the car body 102 are superimposed on one another so that overall a transverse deflection $dy_W$ of the car body 102 results, for which the following applies:

$$dy_W = dy_{Ws} + dy_{Wd}. \quad (3)$$

The setting of the transverse deflection $dy_w$ takes place according to the invention using the setpoint value for the transverse deflection $dy_{w,soll}$ of the car body 102, which is composed of the quasi static component $dy_{ws,soll}$ and the dynamic component $dy_{wd,soll}$, as defined for example in equation (2).

In order to increase the tilting comfort for the passengers the setting (supported by the centrifugal force $F_y$) of the first transverse deflection $dy_{Ws}$ in the present example takes place in a first frequency range F1 that ranges from 0 Hz to 1.0 Hz. The first frequency range thus is the frequency range in which the quasi static rolling motions of the car body corresponding to the current curvature of the curve traveled and the current running speed take place.

In order to increase, in addition to the tilting comfort, the vibration comfort for the passengers, the setting of the second transverse deflection $dy_{Wd}$ in the present example takes place according to the invention in a second frequency range F2, ranging from 1.0 Hz to 6.0 Hz. The second frequency range is a frequency range which is adapted to the dynamic disturbances (as the case may be periodic, typically however rather singular or statistically scattered) expected during operation of the vehicle, which are noticed by passengers and perceived as annoying.

It is self-evident, however, that the first frequency range and/or the second frequency range, depending on the requirements of the rail network and/or the vehicle operator (for example due to the use of the vehicle for local travel or long-distance travel, in particular high-speed travel) can also vary.

By means of the solution according to the invention the first transverse deflection $dy_{Ws}$ of the car body 102, the setting of which ultimately represents a quasi static adaptation of the transverse deflection (and thus of the rolling angle) to the current curve bend and the current running speed, is thus overlaid by a second transverse deflection $dy_{Wd}$ of the car body 102, the setting of which ultimately represents a dynamic adaptation to the current disturbances introduced into the car body so that, overall, a higher comfort for the passengers can be achieved.

The control device 107.2 controls the actuator 107.1 as a function of a series of input variables, which are supplied to it by a higher level vehicle controller and separate sensors (such as for example the sensor 107.3) or similar. The input variables considered for control include, for example, variables which are representative of the current running speed v of the vehicle 101, the curvature $\chi$ of the current curved section being traveled, the track superelevation angle $\gamma$ of the track section currently being traveled and the strength and the frequency of disturbances (such as track geometry disturbances) of the track section currently being traveled.

These variables that are processed by the control device 107.2 can be determined in any suitable manner. In particular, in order to determine the setpoint value of the dynamic second transverse deflection $dy_{Wd,soll}$ it is necessary to determine the disturbances or the resultant transverse accelerations $a_y$, the effects of which are to be at least attenuated via the dynamic component $dy_{Wd}$, with sufficient accuracy and sufficient bandwidth (thus for example to directly measure them and/or calculate them using suitable models of the vehicle 101 and/or the track generated in advance).

Here, the control device 107.2 can be realized in any suitable manner, provided that it meets the safety requirements specified by the operator of the rail vehicle. Thus, for example, it can be made as a single, processor-based system. In the present example, for the regulation in the first frequency range F1 and the regulation in the second frequency range F2 different control circuits or control loops are provided.

In the present example the actuator 107.1, in the first frequency range F1, has a maximum deflection of 80 mm to 95 mm from the neutral position, while, in the second frequency range, it has a maximum deflection of 15 mm to 25 mm from a starting position. In the first frequency range F1 the actuator 107.1 also exerts a maximum actuator force of 15 kN to 30 kN, while, in the second frequency range, it exerts a maximum actuator force of 10 kN to 30 kN. In this way a particularly good configuration from the static and dynamic points of view is achieved.

Through the design of the rolling compensation device 105 as an active system it is furthermore possible in an advantageous manner to design the support of the car body 102 on the running gear 104 in the transverse direction of the vehicle 101 to be relatively stiff. In particular it is possible to position the rolling axis and the instantaneous centre of rotation MP, respectively, of the car body 102 comparatively close to the centre of gravity SP of the car body 102.

Figure 5:
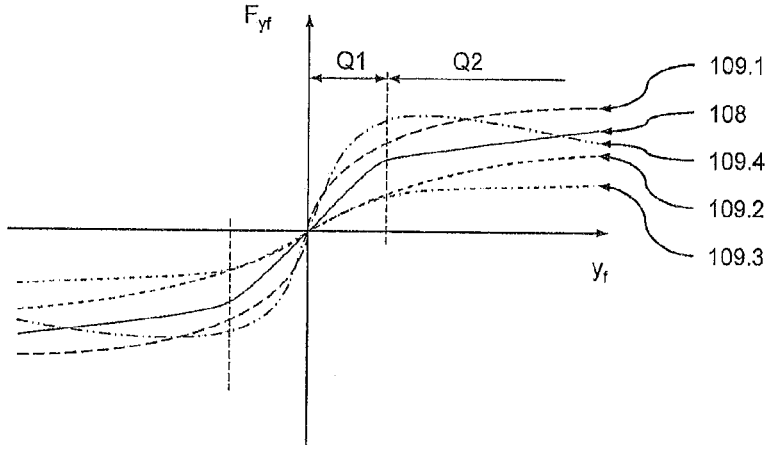
FIG. 5 a transverse force-deflection-characteristic of the spring device of the vehicle from FIG. 1.

In the present example, the secondary suspension 103.2 is designed so that it has a restoring force-transverse deflection characteristic line 108 as shown in FIG. 5. Here, the force characteristic line 108 is an indication of the dependency of the restoring force $F_{yf}$ exerted by the secondary suspension 103.2 on the car body 102, which acts during a transverse deflection $y_f$ of the car body 102 in relation to the bogie frame 104.2. Similarly, for the secondary suspension 103.2, a restoring characteristic line in the form of an moment characteristic line can be indicated, which is an indication of the dependency between the restoring moment $M_{xf}$ exerted by the secondary suspension 103.2 on the car body 102 and the rolling angle deflection $\alpha_W$ from the neutral position.

As can be seen from FIG. 5, the secondary suspension 103.2, in a first transverse deflection range Q1, has a first transverse stiffness R1, while, in a second transverse deflection range Q2 lying above the first deflection range Q1, it has a second transverse stiffness R2 which is less than the first transverse stiffness R1.

Here, it is self-evident that the transverse stiffness (as can be seen from FIG. 5 also from the broken force characteristic lines 109.1, 109.2 of other embodiments) can vary (as the case may be, considerably) within the respective transverse deflection range Q1 or Q2. The respective transverse stiffness R1 or R2 is preferably selected so that the level of the first transverse stiffness R1 at least partially, preferably substantially completely, lies above the level of the second stiffness R2. Of course, a transitional area between the first transverse deflection range Q1 and the second transverse deflection range Q2 can be provided in which there will be an intersection or overlapping, respectively, of the stiffness levels. Basically the behaviour of the stiffness according to the transverse deflection can be adapted to the present application in any suitable manner.

In particular, in advantageous variants of the invention, in the second transverse deflection range Q2 a second gradient at least in the vicinity of the value of zero, preferably equal to zero, can be provided, as indicated in FIG. 5 by the contour 109.3. Similarly, in other variants of the invention, in the second transverse deflection range Q2, a negative second gradient can be provided, as indicated in FIG. 5 by the contour 109.4. In this way, the actuator forces in the event of larger transverse deflections can be kept particularly low in an advantageous manner.

In the present example the stiffness level in the first transverse deflection range Q1 is selected so that the first transverse stiffness R1 is in the range 100 N/mm to 800 N/mm, while the stiffness level in the second transverse deflection range Q2 is selected so that the second transverse stiffness R2 is in the range 0 N/mm to 300 N/mm.

In the present example the force characteristic 108 in the first transverse deflection area Q1 accordingly has a first inclination S1=$dF_{yf}/dy_f$(Q1) and in the transverse deflection area Q2 a second inclination S2=$dF_{yf}/dy_f$(Q2), which is less than the first inclination. The ratio V=S2/S1 of the second inclination S2 to the first inclination S1 is in the range 0 to 3. It is self-evident, however, that with other variants of the invention other values can also be selected for the ratio V.

The two transverse deflection ranges Q1 and Q2 can likewise be selected in any way that is adapted to the respective application. In the present example, the transverse deflection range Q1 extends from 0 mm to 40 mm, while the second transverse deflection range Q2 extends from 40 mm to 100 mm. In this way, with regard to a limitation of the maximum transverse deflection of the car body 102 with the lowest possible energy consumption for the rolling compensation device 105, particularly favourable designs can be achieved.

As already mentioned, for the vehicle 101, similarly to the force characteristic 108, an instantaneous characteristic can be defined. With this approach the restoring characteristic line, in a first rolling angle range W1, has a first inclination S1 and, in a second rolling angle range W2 lying above the first rolling angle range W1, a second inclination which is less than the first inclination. With this approach also the ratio V=S2/S1 of the second inclination S2 to the first inclination S1 is in the range 0 to 3. The first rolling angle range W1 then, depending on the specified kinematics, ranges, for example, from 0° to 1.3°, while the second rolling angle range W2 ranges from 1.0° to 4.0°.

In other words, in the present example therefore a degressive behaviour of the transverse stiffness of the secondary suspension 103.2 is provided, so that an initial transverse deflection of the car body 102 from the neutral position is counteracted by a comparatively high resistance.

The initial high resistance to a transverse deflection has the advantage that in the event of a failure of the active components (for example the actuator 107.1 or the controller 107.2), even when travelling a curve, (according to the currently existing transverse acceleration $a_y$ or the centrifugal force $F_y$) an extensive passive restoration of the car body at least to the vicinity of the neutral position is possible. This passive restoration, in the case of a fault, allows in an advantageous manner particularly wide car bodies 102 and, consequently, a high transport capacity of the vehicle 101 to be achieved. In order to prevent the actuator 107.1 impeding this passive restoration, the actuator 107.1 in the present example is designed so that, in the event of its inactivity, it substantially presents no resistance to a rolling motion of the car body 102. Consequently, the actuator 107.1 is not designed to be self-restraining.

Thanks to the degressive characteristic line 108 the rise of the resistance to the transverse deflection decreases as the deflection increases (with a negative inclination the resistance itself can even fall). With regard to the dynamic setting of the second transverse deflection $dy_{Wd}$ in the second frequency range F2 during travel in curves of the vehicle 101 this is an advantage, since the rolling compensation device 105 must provide comparatively low forces for these dynamic deflections in the second frequency range F2.

The degressive characteristic of the secondary suspension can be achieved in any suitable manner. Thus, for example, as in the present example, the springs, via which the car body 102 is supported on the bogie frame 104.2, can be correspondingly designed so that this characteristic is inherently achieved. In the case of air suspension this can for example take place by a suitable design of the support of the bellows of the respective pneumatic springs.

It is self-evident, however, that the spring device 103 in other variants of the invention can have one or more additional transverse springs, as indicated in FIG. 1 by the broken contour 110. The transverse spring 110 serves to adapt or optimise the transverse stiffness of the secondary suspension 103.2 for the respective application. This simplifies the design of the secondary suspension 103.2 considerably despite the simple optimisation of the transverse stiffness.

The transverse spring 110 can, as shown in the present example, be connected at one end with the running gear frame and at the other with the car body. Additionally or alternatively such a transverse spring can also be connected at one end with the running gear frame or with the car body, while at the other it is connected with the rolling compensation device 105 (for example with a rod 106.5, 106.6). Similarly, the transverse spring can also operate exclusively within the rolling compensation device 105, for example between one of the rods 106.5, 106.6 and the associated lever 106.1 and 106.2, respectively, or the torsion shaft 106.3.

The transverse spring 110 can be designed to increase the stiffness of the spring device in the direction of the vehicle transverse axis. It can have any characteristic adapted for the respective application. Preferably, the transverse spring 110 itself has a degressive stiffness characteristic in order to achieve an overall degressive stiffness characteristic of the secondary suspension 103.2.

The transverse spring 110 can be designed in any suitable manner and work according to any suitable operating principles. Thus, tension springs, compression springs, torsion springs or any combination of these can be used. Furthermore, a purely mechanical spring, an electromechanical spring, a pneumatic spring, a hydraulic spring or any combination of these may be involved.

The transverse stiffness of the secondary suspension 103.2, in the present example, is dimensioned so that, in the event of inactivity of the actuator 107.1 (for example because of a failure of the actuator 107.1 or the controller 107.2), on the car body 102, a restoring moment $M_{xf}$ is exerted about the rolling axis, which is dimensioned so that a rolling angle deflection $\alpha_{not,max}(m_{max};v_o;\gamma_{max})$ of the car body 102 from the neutral position for a nominal loading (e.g. $m=m_{max}$) of the car body 102 and for a vehicle at a standstill (e.g. $v=v_0=0$) on a maximum permitted track superelevation (e.g. $\gamma=\gamma_{max}$) is less than 2°. For the first maximum transverse deflection $dy_{a,not,max}(m_{max};V_o;\gamma_{max})$ of the car body 102 from the neutral position toward the outside of the curve, in the present example, it is the case that it is limited to 60 mm. For the second maximum transverse deflection $dy_{i,not,max}(m_{max};v_o;\gamma_{max})$ of the car body 102 from the neutral position toward the inside of the curve it is the case here that this is limited to 20 mm.

In other words, the secondary suspension 103.2 is designed such that the vehicle 101, if for any reason (for example due to damage to the vehicle or to the track) it comes to a standstill at such an unfavourable spot, as before complies with the specified gauge profile.

Furthermore, the restoring moment $M_{xf}$, when the actuator 107.1 is inactive, must be dimensioned so that a rolling angle deflection $\alpha_{a,not,max}(m_{max};a_{yf,max})$ of the car body 102 from the neutral position for a nominal loading (e.g. $m=m_{max}$) of the car body 102 and for a maximum permitted transverse acceleration ($a_{yf,max}$) acting in the direction of the transverse axis of the vehicle of the vehicle is less than 2°. For the first maximum transverse deflection $dy_{a,not,max}(m_{max};a_{yf,max})$ of the car body 102 from the neutral position toward the outside of the curve, in the present example, it is the case that this is limited to 60 mm. For the second maximum transverse deflection $dy_{i,not,max}(m_{max}a_{yf,max})$ of the car body 102 from the neutral position toward the inside of the curve it is the case here that this is limited to 20 mm.

In other words, the spring device (in particular its stiffness in the vehicle transverse direction) is preferably designed so that a vehicle, in emergency operation in the event of failure of the actuator device, when travelling at normal running speed as before complies with the specified gauge profile.

In any case it is thus ensured, with the present example, that even in the event of failure of the active components of the rolling compensation device 105 emergency operation of the vehicle 101 with as the case may be degraded comfort characteristics (in particular with regard to tilting comfort and/or vibration comfort) is nevertheless possible while complying with the specified gauge profile.

With regard to the high width of the car body 102 that can be achieved and, thus, in connection with the high transport capacity a further advantageous aspect of the design according to the invention exists in the present example in that, through the design and arrangement of the rods 106.5, 106.6, the distance ΔH (that exists in the neutral position of the car body 102) between the rolling axis of the car body 102 and the instantaneous centre of rotation MP, respectively, and the centre of gravity SP of the car body 102 in the direction of the vehicle height axis ($z_f$ direction) is selected to be comparatively small.

Thus the centre of gravity SP of the car body 102, in the present example, has a first height H1=1970 mm above the rail, more accurately stated above the upper surface of the rail SOK, while the rolling axis, in the neutral position (shown in FIG. 1), in the direction of the vehicle height axis has a second height H2 above the upper surface of the rail SOK, which in the present example is in the range 3700 mm to 4500 mm. Accordingly, in the present example the following relationship results $$VH = \frac{H2 - H1}{H1}, \tag{4}$$

which gives the ratio of the difference between the second height H2 and the first height H1 to the first height H1, and which is in the range of approximately 0.8 to approximately 1.3. This allows designs to be achieved which with regard to the abovementioned limitation of the transverse deflections and, thus, the feasibility of wide car bodies with high transport capacity are particularly favourable.

Thus, the comparatively low distance ΔH between the instantaneous centre of rotation MP and the centre of gravity SP has the advantage that firstly, simply as a result of the comparatively small transverse deflections of the car body 102, a comparatively high rolling angle $\alpha_W$ is achieved. In this way, during travel in curves, on the one hand, even at high running speeds v or high curve bends, only comparatively low transverse deflections of the car body 102 are necessary in order to achieve the quasi static component $\alpha_{Ws}$ of the rolling angle $\alpha_W$ and the quasi static component $dy_{ws}$ of the transverse deflection $dy_w$, respectively. Furthermore, as the case may be, even heavy transverse impacts can be compensated by comparatively low transverse deflections of the car body 102, with which the dynamic component $\alpha_{Wd}$ of the rolling angle $\alpha_W$ is created.

In other words, therefore, in normal operation of the vehicle 101 comparatively low transverse deflections are required in order to achieve the desired travel comfort for the passengers. Thanks to the low transverse deflections, in normal operation, a gauge profile that is specified for the rail network on which the vehicle 101 is operated can be adhered to in normal operation even with wide car bodies 102.

A further advantage of the low distance ΔH of the instantaneous centre of rotation MP from the centre of gravity SP lies in the comparatively small lever arm resulting therefrom which the centrifugal force $F_y$ acting on the centre of gravity SP has to the instantaneous centre of rotation MP. In the event of a malfunction of the active components of the rolling compensation device 105 (for example in the event of a failure of the actuator 107.1 or the controller 107.2), the centrifugal force $F_y$ during travel in curves (according to the current transverse acceleration $a_y$) thus exerts a lower rolling moment on the car body 102, so that, at least in the vicinity of the neutral position, an extensive passive restoration of the car body 102 by the secondary suspension 103.2 is possible.

In other words, therefore, even in the event of such a malfunction or an emergency operation of the vehicle 101, comparatively low transverse deflections of the car body 102 occur. Thanks to the low transverse deflections in emergency operation a gauge profile specified for the rail network on which the vehicle 101 is operated can be adhered to even during such emergency operation with wide car bodies 102.

It is self-evident that, with certain variants of the vehicle according to the invention with particularly low transverse deflections, it can be provided (for example by a corresponding design and arrangement of the rods 106.5, 106.6) that the rolling axis or the instantaneous centre of rotation of the car body is at or near the centre of gravity SP of the car body, so that the centrifugal force $F_y$ cannot make any (or at least no significant) contribution to the generation of the rolling motion. The setting of the rolling angle $\alpha_W$ then takes place exclusively actively via the actuator 107.1.

Generally, therefore, it is to be noted that the contribution of the centrifugal force $F_y$ to the setting of the rolling angle $\alpha_W$ is determined by the distance ΔH of the instantaneous centre of rotation MP from the centre of gravity SP. The smaller this distance ΔH is the greater will be the proportion of the actuator force of the actuator 107.1 that will be needed to set the rolling angle $\alpha_W$ (which corresponds to the current running situation and is necessary for the desired travel comfort of the passengers).

In order to ensure adherence to a specified gauge profile in normal operation in any case, in the present example, a limitation of the transverse deflections adapted to the gauge profile specified by the operator of the vehicle is provided which comes into play in limit situations of the operation of the vehicle 101. It is self-evident, however, that, with other variants of the vehicle according to the invention, such a limitation can be used already in normal operation. But, similarly, it can be provided that such a limitation is also absent so that in all possible travel situations and load situations, respectively, of the vehicle no such limitation is active.

The limitation of the transverse deflections can be achieved by any suitable measures, such as for example corresponding stops between the car body 102 and the bogie 104, in particular the bogie frame 104.2. Similarly, a corresponding design of the rolling compensation device 105 can be provided. Thus, for example, corresponding stops for the rods 106.5, 106.6 can be provided.

In the present example, the actuator 107.1 is designed so that a first maximum transverse deflection $dy_{a,max}$ of the car body 102 from the neutral position occurring during travel in curves toward the outside of the curve in the vehicles transverse direction ($y_f$ axis) is limited to 120 mm. Since the bogie 104 is arranged on the vehicle 101 in the end area of the car body 102, it is of particular interest to accordingly limit the transverse deflections toward the inside of the curve. The actuator 107.1 therefore also limits a second maximum transverse deflection $dy_{i,max}$ of the car body 102 from the neutral position toward the inside of the curve occurring in the vehicle transverse direction during travel in curves to 20 mm.

This different limitation of the maximum transverse deflection toward the inside of the curve ($dy_{i,max}$) and toward the outside of the curve ($dv_{a,max}$) is achieved in the present example via the control device 107.2. The control device 107.2 controls the actuator 107.1 for this purpose (according to the direction of the curve currently being traveled) such that, when the respective maximum transverse deflection ($dy_{i,max}$ and $dy_{a,max}$, respectively) is reached, a further transverse deflection beyond the maximum value is prevented.

Furthermore, it can be provided that the control device 107.2 varies the maximum transverse deflection toward the inside of the curve $dy_{i,max}(P)$ and/or toward the outside of the curve $dY_{a,max}(P)$ according to the current position P of the vehicle 101 on the rail network traveled. Thus, for example, in certain track sections toward the inside of the curve and/or toward the outside of the curve a lower maximum transverse deflection of the car body 102 can be permitted than in other track sections. It is self-evident here that the control device 107.2 then must have available corresponding information on the current position P.

Furthermore it can be provided that the control device 107.2 limits the difference $$\Delta\alpha_W=\alpha_{W1}-\alpha_{W2} \tag{5}$$

between the rolling angle $\alpha_{w1}$ on the forward bogie 104 and the rolling angle $\alpha_{w2}$ on the trailing bogie 104 or limits the difference $$\Delta dy_W=dy_{W1}-dy_{W2} \tag{6}$$

between the transverse deflection $dy_{w1}$ on the forward bogie 104 and the transverse deflection $dy_{w2}$ on the trailing bogie 104. Here also, a similar active setting of the limitation can be carried out, as the case may be, dependent upon the current section of track and/or other variables (such as for example the rolling speed in the area of the respective bogie 104).

As can be seen from FIG. 1, the spring device 103 also has an emergency spring device 130.3, which is arranged centrally on the running gear 104.2 in the vehicle transverse direction, in order that, even if the secondary suspension 103.2 fails, emergency operation of the vehicle 101 is possible. The emergency spring device 103.3 can basically be designed in any manner. In the present example the emergency spring device 103.3 is designed so that it supports the compensation effect of the rolling compensation device 105. To this end, the emergency spring device 103.3 can comprise a sliding and/or rolling guide which (in the event of it being used, thus in emergency mode) can follow the compensation motion of the rolling compensation device 105.

Basically it can be provided that the active setting of the rolling angle and of the transverse deflection, respectively, via the rolling compensation device 105 takes place exclusively during travel in curves on the curved track, and therefore the first rolling compensation device 105 is active only in such a travel situation. In the present example, the rolling compensation device 105 is also active during straight travel of the vehicle 101, so that in any travel situation at least a setting of the transverse deflection $dy_W$ and, as the case may be, the rolling angle $\alpha_W$, respectively, takes place in the second frequency range F2 and, thus, the vibration comfort in an advantageous manner is also guaranteed in these travel situations.

Second Embodiment

Figure 6:
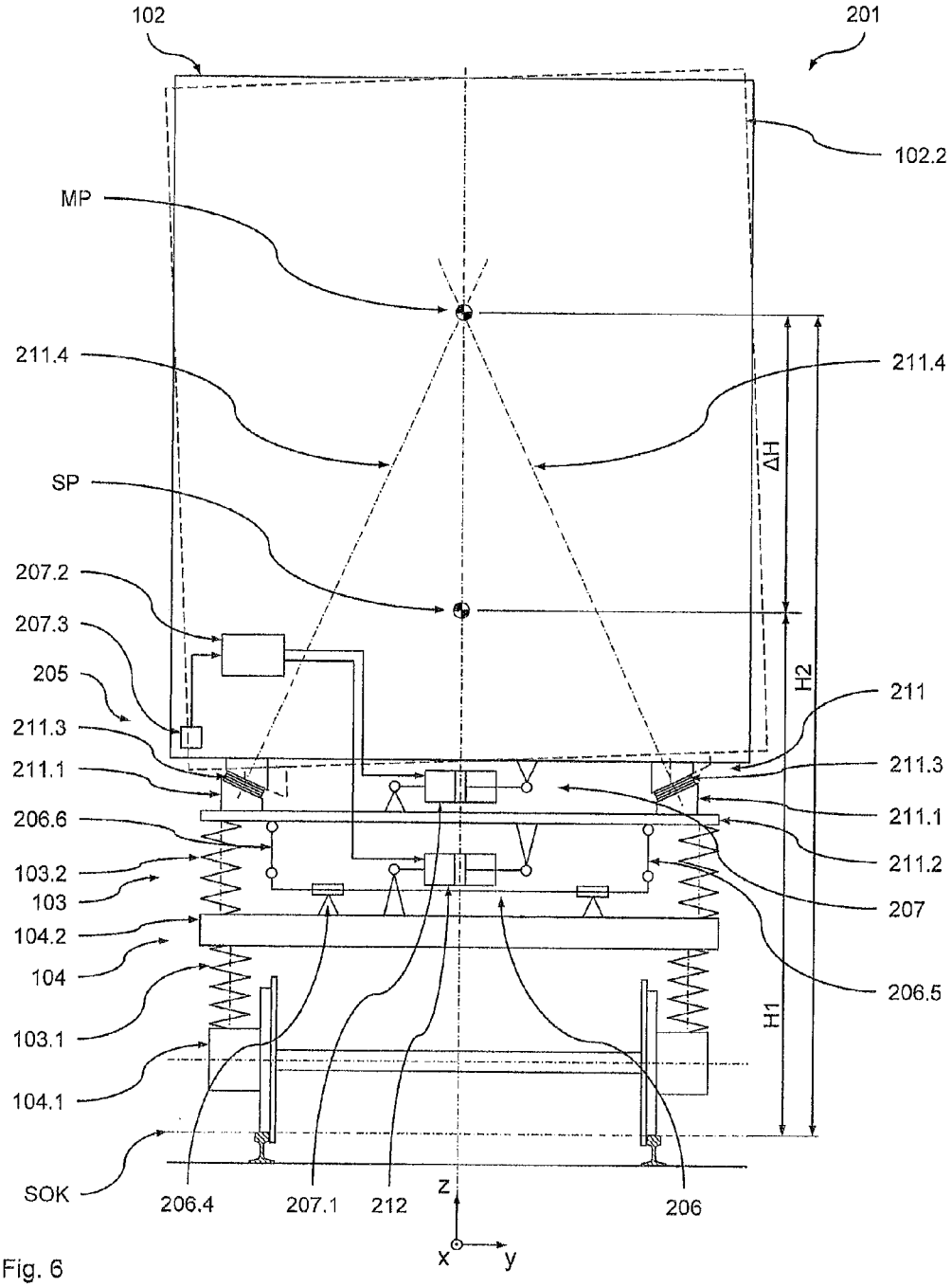
FIG. 6 a schematic sectional view of a further preferred embodiment of the vehicle according to the invention in the neutral position.

A further advantageous embodiment of the vehicle 201 according to the invention is shown in FIG. 6. The vehicle 201, in its basic design and functionality, corresponds to vehicle 101 from FIGS. 1 to 5, so that here merely the differences will be dealt with. In particular, identical components are provided with identical reference numerals, while similar components are provided with reference numerals incremented by a value of 100. Unless otherwise stated in the following, regarding the features, functions and advantages of these components reference is made to the above statements made in connection with the first embodiment.

The difference from the example in FIGS. 1 to 5 lies in the design of the rolling compensation device 205. Unlike in vehicle 101 the latter is arranged kinematically in series with the spring device 103 via which the car body 102 is supported on the wheel units 104.1 of the respective bogie 104.

The rolling compensation device 205 comprises a guiding device 211, which is arranged kinematically in series with the spring device 103. The guiding device 211 comprises two guiding elements 211.1, which are supported at one end on a support 211.2 and at the other on the car body 102, respectively. The support 211.2 extends in the vehicle transverse direction and for its part is supported via the secondary suspension 103.2 on the bogie frame 104.2.

During rolling motions of the car body 102, the guiding elements 211.1 define the motion of the support 211.2 in relation to the car body 102. The respective guiding element 211.1 is designed as a simple multilayered spring device comprising a multilayered rubber layer spring 211.3.

The rubber layer spring 211.3 is constructed from a plurality of layers, wherein for example metal and rubber layers are interleaved. The rubber layer spring 211.3 is compressively rigid in a direction perpendicular to its layers (so that the layer thickness under loading does not change significantly in this direction) while, in a direction parallel to its layers, it is flexible (so that under axial loading a significant deformation in this direction takes place). The layers of the rubber layer spring 211.3, in the present example, are arranged at an inclination to the vehicle height axis and to the vehicle transverse axis, so that they define the rolling axis and the instantaneous centre of rotation MP, respectively, of the car body 102.

In the present example the layers of the rubber multilayered spring 211.3 are designed as simple flat layers and such that the point of intersection of their mid-normals 211.4 defines the rolling axis and the instantaneous centre of rotation MP, respectively, of the car body 102. It is self-evident, however, that, with other variants of the invention, another singly or multiply curved design of these layers can be provided. In particular, it can be a case of concentric cylinder sleeve segments whose centres of curvature lie in the instantaneous centre of rotation MP.

In the present example, the mid-normals 211.4 lie in a common plane, which runs perpendicular to the vehicle longitudinal axis ($x_f$ axis). Accordingly the arrangement of the two rubber layer springs 211.3, in the vehicle transverse direction, can also transmit comparatively high forces without additional aids, while in the direction of the vehicle longitudinal axis only limited forces can be transmitted without considerable shear deformation. Accordingly, as a rule between the car body 102 and the bogie frame 104.2 a longitudinal articulation is provided, which allows a corresponding transmission of forces in the direction of the vehicle longitudinal axis.

It is self-evident, however, that, with other variants of the invention, another design of the rubber multilayered springs 211.3 can be provided, which allows the transmission of such longitudinal forces. Thus, for example, doubly curved layers can be provided. Similarly, however, more than two rubber layer springs can be provided which are not collinear and are thus spatially arranged so that their mid-perpendiculars and their radii of curvature, respectively, intersect in the instantaneous centre of rotation MP of the car body.

As can further be inferred from FIG. 6, the rolling compensation device 205 again comprises an actuator device 207 with an actuator 207.1 and a control device 207.2 connected thereto. In a similar manner to the actuator 107.1, the actuator 207.1 acts in the vehicle transverse direction between the support 211.2 and the car body 102.

Under the control of the control device 207.2, via the actuator 207.1, the rolling angle $\alpha_W$ and the transverse deflection $dy_w$, respectively, is set (as shown in FIG. 6 by the broken contour 102.2). The control device 207.2, in the present example, operates similarly to the control device 107.2. In particular, the control device 207.2 controls or regulates the actuator force and/or the deflection of the actuator 207.1 according to the present invention in such a way that a quasi static first transverse deflection $dy_{Ws}$ of the car body 102 and a dynamic second transverse deflection $dy_{Wd}$ of the car body 102 are overlaid on one another so that, overall, a transverse deflection $dy_W$ of the car body 102 results, for which the above equation (2) applies. Here also, the quasi static first transverse deflection $dy_{Ws}$ is again set in the first frequency range F1, while the dynamic second transverse deflection $dy_{Wd}$ is set in the second frequency range F2.

In the event of inactivity of the active components (thus, for example, of the actuator 207.1 or the controller 207.2) of the rolling compensation device 205, the passive restoration of the car body takes place via the elastic resetting force of the rubber layer springs 211.3. The rubber layer springs 211.3 can be designed in such a way that they have a similar characteristic to the secondary suspension 103.2 from the first embodiment, so that in this regard reference is made to the statements above.

As can further be inferred from FIG. 6, between the bogie frame 104.2 and the support 211.2 (kinematically in parallel with the secondary suspension 103.2) a conventional rolling support 206 with rods 206.5, 206.6 running parallel to one another is provided, which counteracts an uneven dipping of the secondary suspension 103.2. Additionally, between the bogie frame 104.2 and the support 211.2, in the vehicle transverse direction, a further actuator 212 of the rolling compensation device 205 operates, via which the transverse deflection of the support 211.2 and thus also of the car body 102 in relation to the bogie frame 104.2 can be influenced. It is self-evident, however, that, in other variants of the invention, on the one hand such an additional actuator can, as the case may be, be dispensed with and, on the other hand, that also again an inclined arrangement of the rods can be provided.

The actuator 212 is likewise controlled by the control device 207.2 so that the control device 207.2, by controlling the actuators 207.1 and 212, can bring about an operational behaviour of the rolling compensation device 205 like that which has already been described above in connection with the first embodiment for the rolling compensation device 105.

Here again it is pointed out that the design of the rolling compensation device with such a layer spring device for definition of the rolling axis of the car body constitutes an individually patentable inventive idea, which is, in particular, independent of the setting, as described above, of the transverse deflection (and as the case may be the rolling angle, respectively) in the first frequency range F1 and the second frequency range F2.

Third Embodiment

Figure 7:
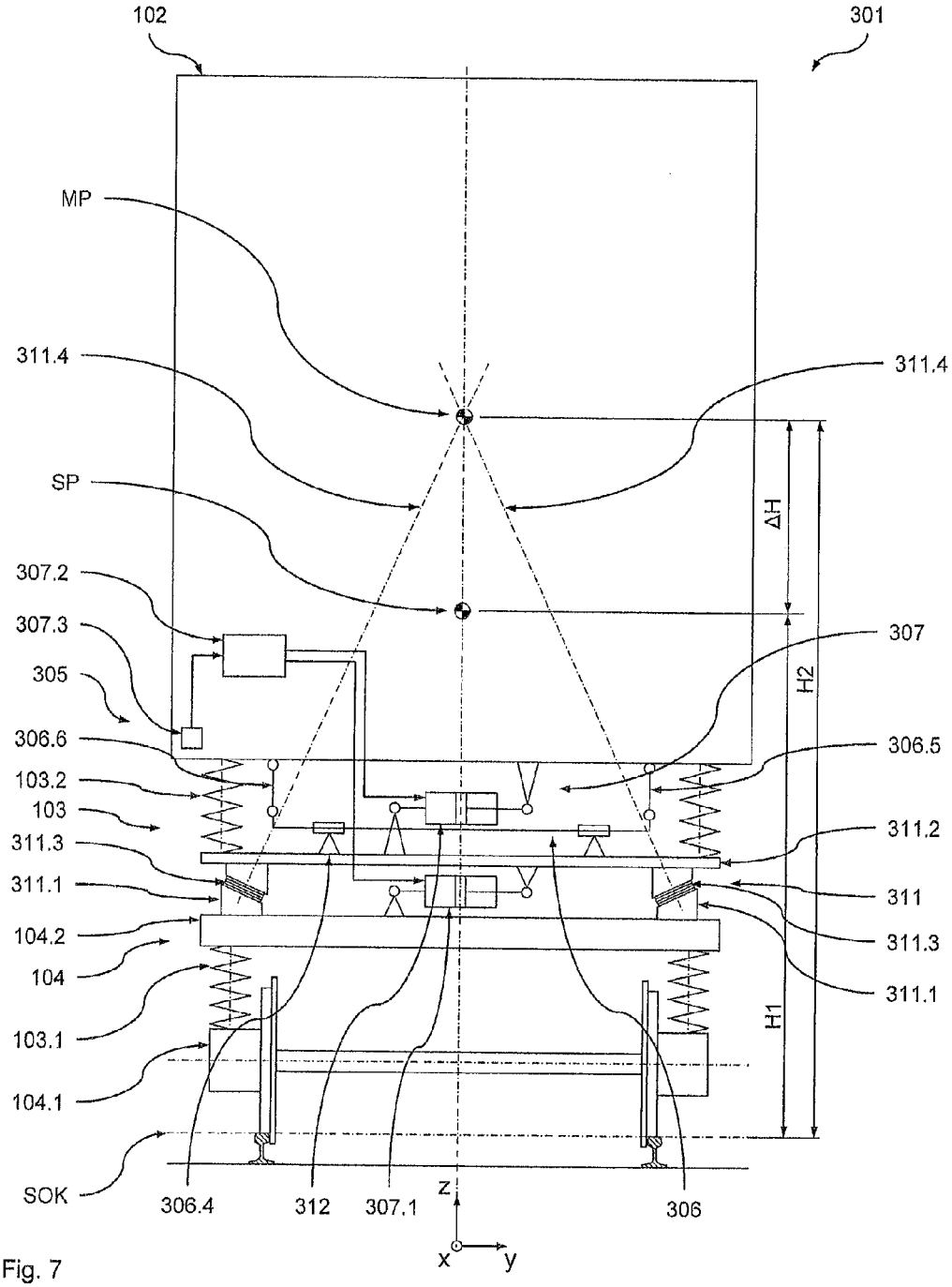
FIG. 7 a schematic sectional view of a further preferred embodiment of the vehicle according to the invention in the neutral position.

A further advantageous embodiment of the vehicle according to the invention 301 is shown in FIG. 7. The vehicle 301, in its basic design and functionality, corresponds to vehicle 201 from FIG. 6, so that here merely the differences will be dealt with. In particular, identical components are provided with identical reference numerals, while similar components are provided with reference numerals incremented by a value of 200. Unless otherwise stated in the following, regarding the features, functions and advantages of these components reference is made to the above statements in connection with the first embodiment.

The difference from the example of FIG. 6 lies merely in the arrangement of the rolling compensation device 305. Unlike vehicle 201 the latter is arranged kinematically in series between the primary suspension 103.1 and the secondary suspension 103.2, via which the car body 102 is supported on the wheel units 104.1 of the respective bogie 104.

The rolling compensation device 305 again comprises a guiding device 311 with two guiding elements 311.1, which are supported, on the one hand, on a support 311.2 and, on the other hand, on the bogie frame 104.2. The car body 102 is supported via the secondary suspension 103.2 on the support 311.2, which extends in the vehicle transverse direction.

The guiding elements 311.1 are designed like the guiding elements 211.1 and, during rolling motions of the car body 102, define the motion of the support 311.2 in relation to the bogie frame 104.2. The respective guiding element 311.1 is again designed as a simple multilayered spring device, which comprises a rubber layer spring 311.3, with a design similar to the rubber layer spring 211.3.

As can further be inferred from FIG. 7, the rolling compensation device 305 again comprises an actuator device 307 with an actuator 307.1 and a control device 307.2 connected thereto, which operate in a manner analogous to the actuator 207.1 and the control device 207.2.

As can be further inferred from FIG. 7, between the car body 102 and the support 311.2 (kinematically in parallel with the secondary suspension 103.2) a conventional rolling support 306 with rods 306.5, 306.6 running parallel to one another is provided, which counteracts an uneven dipping of the secondary suspension 103.2. Additionally, between the car body 102 and the support 311.2, in the vehicle transverse direction, a further actuator 312 of the rolling compensation device 305 acts, via which the transverse deflection of the car body 102 in relation to the support 311.2 and, thus, also in relation to the bogie frame 104.2 can be influenced.

The actuator 312 is likewise controlled by the control device 307.2 so that the control device 307.2, by controlling the actuators 307.1 and 312, can bring about an operational behaviour of the rolling compensation device 305 like that which has already been described above in the context of the first and second embodiment.

The present invention has been described above exclusively using examples for rail vehicles. It is further self-evident that the invention can also be used in connection with any other vehicles.

The invention claimed is:

1. A rail vehicle includes:

a car body, which is supported on a running gear in a direction of a vehicle height axis by of a spring device, and a rolling compensation device, which is coupled to the running gear and the car body, wherein the rolling compensation device is arranged kinematically in parallel to the spring device;

the rolling compensation device counteracts rolling motions of the car body toward the outside of the curve about a rolling axis parallel to the vehicle longitudinal axis during travel in curves;

the rolling compensation device in order to increase the tilting comfort, is designed to impose, in a first frequency range and under a first transverse deflection of the car body, upon the car body, in the direction of the vehicle transverse axis, a first rolling angle about the rolling axis, which corresponds to a current curvature of a current section of track being travelled, wherein the rolling compensation device, in order to increase the vibration comfort, is designed to impose, in a second frequency range, upon the car body a second transverse deflection overlaid to the first transverse deflection, wherein the second frequency range at least partially lies above the first frequency range.

2. The rail vehicle according to claim 1, wherein the rolling compensation device has an actuator device with at least one first actuator unit controlled by a control device, wherein the actuator device is designed to make at least a majority contribution to the generation of the first rolling angle in the first frequency range.

3. The rail vehicle according to claim 1, wherein the first frequency range ranges from 0 Hz to 2 Hz, or the second frequency range ranges from 0.5 Hz to 15 Hz, or the rolling compensation device is also active during straight travel.

4. The rail vehicle according to claim 1, wherein the car body has a neutral position, which it adopts when the vehicle is stationary on a straight, level track, and the rolling compensation device is configured in such a way that a first maximum transverse deflection of the car body from the neutral position occurring toward the outside of the curve during travel in curves, in a vehicle transverse direction, is limited to 80 mm to 150 mm, or a second maximum transverse deflection of the car body from the neutral position occurring toward the inside of the curve during travel in curves, in a vehicle transverse direction, is limited to 0 mm to 40 mm.

5. The rail vehicle according to claim 1, wherein an actuator device of the rolling compensation device is configured to act as an end stop device for definition of at least one end stop for the rolling motion of the car body, wherein the actuator device is designed to define the position of the at least one end stop for the rolling motion of the car body in a variable fashion.

6. The rail vehicle according to claim 1, wherein an actuator device of the rolling compensation device, in the event of its inactivity, offers at most only slight resistance to a rolling motion of the car body.

7. The rail vehicle according to claim 1, wherein the car body has a neutral position, which it adopts when the vehicle is stationary on a straight, level track, the spring device, in the event of inactivity of an actuator device of the rolling compensation device, exerts on the car body a restoring moment about the rolling axis, wherein the restoring moment, in the event of an inactive actuator device, is dimensioned such that a transverse deflection of the car body from the neutral position for a stationary vehicle under a nominal loading of the car body and with a maximum permitted track superelevation is less than 10 mm to 40 mm, or a transverse deflection of the car body from the neutral position, under a nominal loading of the car body and with a maximum permitted transverse acceleration of the vehicle acting in the direction of a vehicle transverse axis, is less than 40 mm to 80 mm.

8. The rail vehicle according to claim 7, wherein the spring device defines a restoring characteristic line, wherein the restoring characteristic line represents the dependence of the restoring moment on the rolling angle deflection and the restoring characteristic line has a degressive behaviour, wherein the restoring characteristic line in a first rolling angle range, has a first inclination and, in a second rolling angle range above the first rolling angle range, has a second inclination that is less than the first inclination, wherein the ratio of the second inclination to the first inclination lies in the range from 0 to 1, or the first transverse deflection range ranges from 0 mm to 60 mm, and the second transverse deflection range ranges from 20 mm to 120 mm.

9. The rail vehicle according to claim 8, wherein the car body has a neutral position, which it adopts when the vehicle is stationary on a straight, level track, and the spring device, in the direction of a vehicle transverse axis, has a transverse stiffness, which is a function of a transverse deflection of the car body in the direction of the vehicle transverse axis from the neutral position, wherein the spring device in a first transverse deflection range, has a first transverse stiffness and, in a second transverse deflection range lying above the first transverse deflection range, has a second transverse stiffness, which is lower than the first transverse stiffness, wherein the first transverse stiffness lies in the range from 100 N//mm to 800 N/mm and the second transverse stiffness lies in the range from 0 N/mm to 300 N/mm, or the first transverse deflection range ranges from 0 mm to 60 mm and the second transverse deflection range ranges from 20 mm to 120 mm.

10. The rail vehicle according to claim 1, wherein the car body has a nominal loading and a neutral position, which it adopts when the vehicle is stationary on a straight, level track, and the spring device, in the direction of a vehicle transverse axis, has a transverse stiffness, wherein the transverse stiffness of the spring device is dimensioned such that, in the event of inactivity of an actuator device of the rolling compensation device, during travel in curves with a maximum permissible transverse acceleration of the vehicle acting in the direction of a vehicle transverse axis, a first maximum transverse deflection of the car body from the neutral position toward the outside of the curve in a vehicle transverse direction is limited to 40 mm to 120 mm, or a second maximum transverse deflection of the car body from the neutral position toward the inside of the curve in a vehicle transverse direction is limited to 0 mm to 60 mm.

11. The rail vehicle according to claim 1, wherein the car body has a neutral position, which it adopts when the vehicle is stationary on a straight, level track, and the rolling compensation device is designed in such a way that an actuator device of the rolling compensation device, in the first frequency range, has a maximum deflection from the neutral position of 60 mm to 110 mm, or, in the second frequency range, from a starting position, has a maximum deflection of 10 mm to 30 mm, or, in the first frequency range, exerts a maximum actuator force of 10 kN to 40 kN, or, in the second frequency range, exerts a maximum actuator force of 5 kN to 35 kN.

12. The rail vehicle according to claim 1, wherein the car body has a neutral position, which it adopts when the vehicle is stationary on a straight, level track, the car body has a centre of gravity which, in the neutral position, in the direction of the vehicle height axis has a first height above the track, the rolling compensation device is configured in such a way that the rolling axis, in the neutral position, in the direction of the vehicle height axis has a second height above the track, wherein the ratio of the difference between the second height and the first height to the first height is a maximum of 2.2.

13. The rail vehicle according to claim 1, wherein the rolling compensation device comprises a rolling support device, which is arranged kinematically in parallel to the spring device and is designed to counteract rolling motions of the car body about the rolling axis during straight travel, wherein the rolling support device comprises two rods, each of which, at one end, is connected in an articulated manner to the car body and each of which, at the other end, is connected in an articulated manner to opposing ends of a torsion element, which is supported by the running gear, or the rolling compensation device comprises a guiding device, the guiding device is arranged kinematically in series with the spring device, the guiding device comprises a guiding element, which is arranged between the running gear and the car body, and the guiding device is configured so that, during rolling motions of the car body, it defines a motion of the guiding element in relation to the car body or the running gear, wherein the guiding device comprises at least one layer spring device.

14. The rail vehicle according to claim 1, wherein the running gear has a running gear frame and at least one wheel unit and the spring device has a primary suspension and a secondary suspension, wherein the running gear frame is supported via the primary suspension on the wheel unit, and the car body is supported on the running gear frame via the secondary suspension, which is designed as pneumatic suspension, and the rolling compensation device is arranged kinematically in parallel to the secondary suspension between the running gear frame and the car body.

15. The rail vehicle according to claim 14, wherein the spring device comprises a transverse spring device, wherein the transverse spring device is connected at one end to the running gear frame and at the other to the car body, or is connected at one end to the running gear frame or to the car body and at the other to the rolling compensation device and the transverse spring device is configured to increase the stiffness of the spring device in the direction of a vehicle transverse axis, wherein the transverse spring device has a degressive stiffness characteristic.

16. The rail vehicle according to claim 1, wherein the spring device has an emergency spring device, which, in the vehicle longitudinal direction, is arranged centrally on the running gear, wherein the emergency spring device is configured so that it supports the compensation effect of the rolling compensation device.

17. A method for setting a rolling angle on a car body of a rail vehicle supported on a running gear in a direction of a vehicle height axis, about a rolling axis parallel to a vehicle longitudinal axis of the vehicle, in which the rolling angle is actively set, wherein, during travel in curves, rolling motions of the car body toward an outside of a curve about a rolling axis parallel to the vehicle longitudinal axis are counteracted and, in order to increase the tilting comfort, the car body, in a first frequency range and under a transverse deflection , has a first rolling angle imposed upon it, which corresponds to a current curvature of a current section of track being travelled, wherein the car body, in order to increase the vibration comfort, in a second frequency range, has a second transverse deflection overlaid to the first transverse deflection imposed upon it, wherein the second frequency range at least partially lies above the first frequency range.

18. The method according to claim 17, wherein the first rolling angle, in the first frequency range, at least predominantly, is generated actively.

19. The method according to claim 17, wherein the first frequency range ranges from 0 Hz to 2 Hz, or the second frequency range ranges from 0.5 Hz to 15 Hz.

20. The method according to claim 17, wherein the setting of the second transverse deflection, in the second frequency range, for increasing the vibration comfort also takes place during straight travel.

* * * * *

UNITED STATES PATENT AND TRADEMARK OFFICE

CERTIFICATE OF CORRECTION

PATENT NO. : 8,356,557 B2
APPLICATION NO. : 13/259565
DATED : January 22, 2013
INVENTOR(S) : Richard Schneider It is certified that error appears in the above-identified patent and that said Letters Patent is hereby corrected as shown below:

Column 25, Line 9, Claim 1, after "by" delete "of"

Column 25, Line 20, Claim 1, after "device" insert -- , --

Column 26, Line 39, Claim 8, after "60 mm" delete ","

Signed and Sealed this
Second Day of April, 2013

Teresa Stanek Rea
*Acting Director of the United States Patent and Trademark Office*